US006389696B1

(12) United States Patent
Heil et al.

(10) Patent No.: US 6,389,696 B1
(45) Date of Patent: May 21, 2002

(54) PLATE HEAT EXCHANGER AND METHOD OF MAKING SAME

(75) Inventors: Dietmar Heil, Schwendi; Bruno Motzet, Weilheim/Teck; Konrad Schwab, Esslingen; Alois Tischler, Aidenbach; Marc Weisser, Owen/T., all of (DE)

(73) Assignee: Xcellsis GmbH, Kirchheim/Teck-Nabern (DE)

( * ) Notice: Subject to any disclaimer, the term of this patent is extended or adjusted under 35 U.S.C. 154(b) by 0 days.

(21) Appl. No.: 09/679,527

(22) Filed: Oct. 6, 2000

(30) Foreign Application Priority Data

Oct. 7, 1999 (DE) ..... 199 48 222

(51) Int. Cl.[7] ..... B23P 15/26; F28F 13/08; F28F 3/08

(52) U.S. Cl. ..... 29/890.039; 165/147; 165/167; 165/139; 165/146

(58) Field of Search ..... 165/167, 139, 165/166, 146, 147; 29/890.039

(56) References Cited

U.S. PATENT DOCUMENTS

| | | | | | |
|---|---|---|---|---|---|
| 3,117,624 | A | * | 1/1964 | Wennerberg | 165/167 |
| 3,430,694 | A | | 3/1969 | Cardell | 165/166 |
| 3,661,203 | A | * | 5/1972 | Mesher | 165/167 |
| 3,759,308 | A | * | 9/1973 | Gebauer | 165/167 X |
| 4,073,340 | A | * | 2/1978 | Parker | 165/166 |
| 4,186,159 | A | * | 1/1980 | Huber | 165/166 X |
| 4,586,565 | A | * | 5/1986 | Hallstrom et al. | 165/167 |
| 4,630,674 | A | * | 12/1986 | Skoog | 165/147 |
| 4,781,248 | A | * | 11/1988 | Pfeiffer | 165/167 |
| 5,538,700 | A | * | 7/1996 | Koves | 165/167 X |
| 5,700,434 | A | * | 12/1997 | Gaiser | 165/167 X |

FOREIGN PATENT DOCUMENTS

| | | | |
|---|---|---|---|
| AT | 317 269 | 8/1974 | |
| CH | 277448 | 12/1951 | |
| DE | 1 960 947 | 7/1970 | |
| DE | 196 54 361 | 6/1998 | |
| FR | 834829 | * 12/1938 | 165/167 |
| SU | 144179 | * 3/1961 | 165/167 |
| WO | WO 91/16589 | 10/1991 | 165/167 |

* cited by examiner

*Primary Examiner*—Leonard Leo
(74) *Attorney, Agent, or Firm*—Crowell & Moring LLP

(57) ABSTRACT

Plate heat exchanger has heat transfer plates which exhibit a patterning and are stacked one above the other. Primary sided flow channels for a first heat exchanger medium to be evaporated, and secondary sided channels for a second heat exchanger heat carrier medium are formed between the plates. The primary sided and/or the secondary sided flow channels are formed between two adjacent heat transfer plates, whose patterning meshes at least partially, while maintaining a minimum spacing.

21 Claims, 1 Drawing Sheet

PLATE HEAT EXCHANGER AND METHOD OF MAKING SAME

This application claims the priority of 199 48 222.5, filed Oct. 7, 1999 in Germany, the disclosure of which is expressly incorporated by reference herein.

BACKGROUND AND SUMMARY OF THE INVENTION

The present invention relates to a plate heat exchanger, comprising heat transfer plates, which exhibit a patterning stacked one above the other, and between which primary sided flow channels are formed for a first heat exchanger medium to the evaporated, and secondary sided channels are formed for a second heat exchanger heat carrier medium, wherein at least some of the primary sided and secondary sided flow channels are formed between two adjacent heat transfer plates, with patterning meshing at least partially, while maintaining a minimum spacing.

A plate evaporator for evaporating fluids with a number of stacked heat transfer plates is disclosed in the WO 91/16589. The corrugated sheet metal-like configuration of the heat transfer plates provides here between the individual plates the flow chambers for the heat exchanger mediums. To create optimal flow resistance for the fluid and the generated steam, the sweep angles of the individual flow channels along the length of the plate evaporator can be varied.

Furthermore, it is known to arrange heat transfer plates, designed in fishbone-like patterning, alternatingly and in the opposite directions, in order to produce cross channel structures. That is, in essence W-shaped fishbone-like patterning and M-shaped fishbone-like patterning are stacked one over the other. In so doing, the sweep angle is constant over the entire flow length of the plate heat exchanger in accordance with the fishbone-like patterning. Sweep angle is defined here as the angle between the main direction of flow of the heat exchanger mediums and the fishbone-like patterning of the heat transfer plates. The mediums flow in and out in the conventional manner through one borehole each, which communicates with the corresponding flow channels of the plate heat exchanger. The overall result of the alternating arrangement of w- and m-shaped, fishbone-like patterns for both heat exchanger mediums is an identical flow channel volume (identical volume on the primary and secondary side of the plate heat exchanger).

One drawback with the conventional plate heat exchangers lies in the fact that owing to the cross channel structures produced by the alternating arrangement of the fishbone-like patterning, the flow channels exhibit a relatively large volume. This leads, for example, in mediums to be evaporated to the occurrence of the Leidenfrost phenomenon, which, for example, can also be observed when a drop of water falls on a hot stove plate. Despite the thermal effect, the drop of water does not evaporate, but rather splits into a number of smaller drops.

Therefore, an object of the invention is to provide a plate heat exchanger, with which efficient evaporation can be carried out, while avoiding, in particular, the Leidenfrost phenomenon.

This problem is solved by a plate heat exchanger comprising heat transfer plates which exhibit a patterning stacked one above the other, and between which primary sided flow channels are formed for a first heat exchanger medium to be evaporated, and secondary sided channels are formed for a second heat exchanger heat carrier medium, wherein at least some of the primary sided and secondary sided flow channels are formed between two adjacent heat transfer plates, with patterning meshing at least partially, while maintaining a minimum spacing.

With the inventive plate heat exchanger it is now possible to design in particular the flow channels for a medium to be evaporated small and/or narrow so that only a small flow volume is available in particular on the primary side. This measure makes it possible to transfer the heat quite well to a medium to be evaporated, thus effectively avoiding, for example, effects like the Leidenfrost phenomenon.

Advantageous embodiments of the plate heat exchanger of the invention are described herein and in the claims.

According to an especially preferred embodiment of the inventive plate heat exchanger, the heat transfer plates are designed as plates with a fishbone-like patterning. To form the primary sided flow channels, two patternings, which run essentially in the same direction, are stacked one above the other; and to form the secondary sided flow channels, patternings, running in the opposite direction, are stacked one above the other for the purpose of producing cross channel structures. Both sides of the plates that are shaped in a fishbone-like patterning exhibit a patterning that can be used according to the invention. In stacking the essentially uniform fishbone-like patterning, two heat transfer plates can be moved very close to each other in order to form very narrow flow channels. Elevations of the one pattern mesh with the depressions of the other pattern while retaining a minimum or desired spacing. Correspondingly stacking a fishbone-like patterning, which does not run in the same direction or runs in the opposite direction, can provide a flow channel side with relatively large volume. In this case owing to the cross channel structure the result is very good heat transfer of a heat carrier medium to the heat transfer plates.

Expediently spacing elements are provided between the heat transfer plates for the purpose of adjusting the height of the flow channels. Especially in the case of heat transfer plates, whose patterning, running in the same direction, is stacked one above the other, such spacing elements can guarantee the desired and necessary minimum distance in order to provide an adequate channel diameter. With such spacing elements both the primary and the secondary sided flow channels can be optimally adapted to the concrete features. Moreover, the spacing elements have proven to be advantageous, because, as the mediums flow through the channel, they generate turbulence, thus further improving the heat exchanger properties of the plate heat exchanger.

Another preferred embodiment of the inventive plate heat exchanger provides an inlet channel, which extends through the heat transfer plates and communicates with the primary sided or secondary sided flow channels, for the purpose of introducing the heat exchanger medium into the plate heat exchanger. The embodiment also provides two outlet channels, which extend through the heat transfer plates and communicate with the primary sided or secondary sided flow channels, for the purpose of dispensing the heat exchanger medium. With these measures it is possible to achieve a very uniform flow of the heat exchanger medium inside the plate heat exchanger, thus effectively avoiding temperature gradient-induced thermal or mechanical stresses of the plate heat exchanger.

Expediently there is an inlet opening on one end of the plate heat exchanger in the region of its center axis relative to the main direction of flow. At the same time outlet boreholes on the other end of the plate heat exchanger are offset symmetrically relative to the center axis. Thus an essentially Y-shaped flow of the heat exchanger mediums can be guaranteed by the heat exchanger, a feature that results in an overall symmetrical temperature distribution. In this respect, excess thermal stress, in particular the risk of overheating, as occurs in conventional plate heat exchangers, can be effectively avoided.

According to another preferred embodiment of the inventive plate heat exchanger, a sweep angle of the patterning of the heat transfer plates is varied in the main direction of flow relative to the center axis of the plate heat exchanger. For example, decreasing the sweep angle in the flow direction of the heat carrier minimizes a pressure loss of the heat carrier. The same applies to a decreasing sweep angle in the flow direction of the medium to be evaporated.

In an advantageous improvement of the invention the primary sided and/or secondary sided flow channels exhibit a coating, with which the efficiency of the heat exchanger is improved by increasing the heat transfer area, when the coating exhibits a defined roughness.

In another design of the invention the coating of the primary sided and/or secondary sided flow channels is doped with a catalyst material, with which it is possible to generate a catalytic reaction in the heat exchanger.

Other objects, advantages and novel features of the present invention will become apparent from the following detailed description of the invention when considered in conjunction with the accompanying drawings.

DETAILED DESCRIPTION OF THE DRAWINGS

Figure 1:
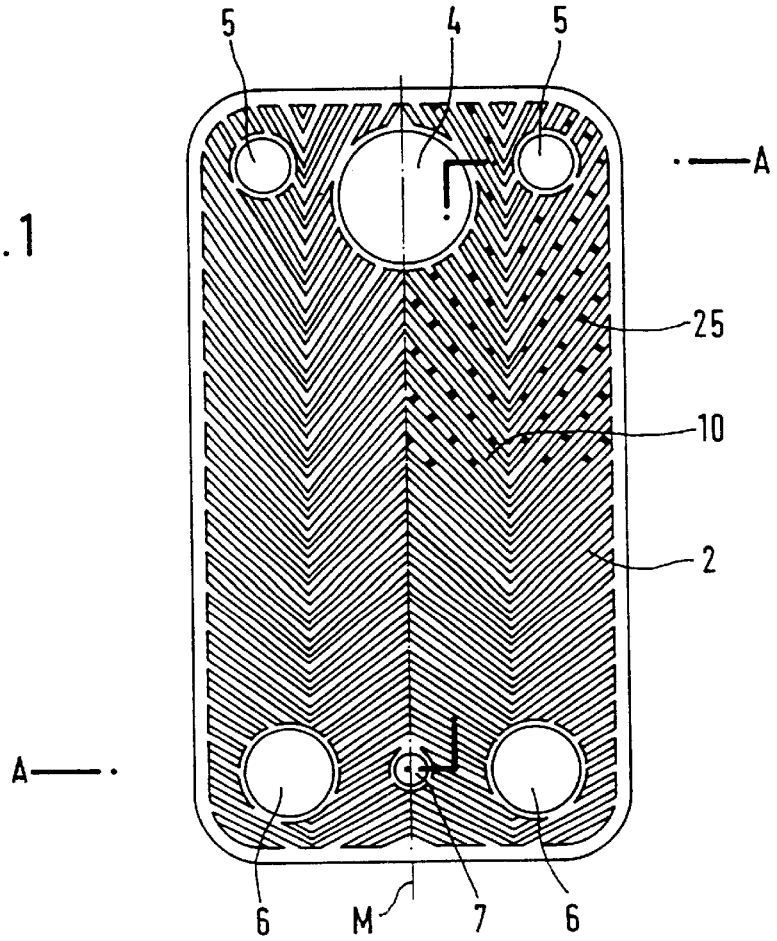
FIG. 1 is a schematic drawing of a top view of a heat transfer plate, which forms a part of the plate heat exchanger of a preferred embodiment of the invention.

FIG. 1 is a schematic top view of a heat transfer plate. One recognizes a fishbone-like patterning 10, for example, embossed into a sheet metal plate. The patterning 10 exhibits elevations and depressions. Even the rearside of the heat transfer plate 2, which is not visible in the drawing of FIG. 1, exhibits a corresponding patterning. The heat transfer plate 2 is designed with a number of boreholes 4, 5, 6, 7. When a number of heat transfer plates 2 are stacked one above the other, these boreholes form inlet channels or outlet channels for the heat exchanger mediums, as described below. It is evident from FIG. 1 that two boreholes 4, 7 are arranged on the center axis M of the heat transfer plate, whereas the other boreholes 5 or 7 are positioned symmetrically relative to this center axis M.

Figure 2:
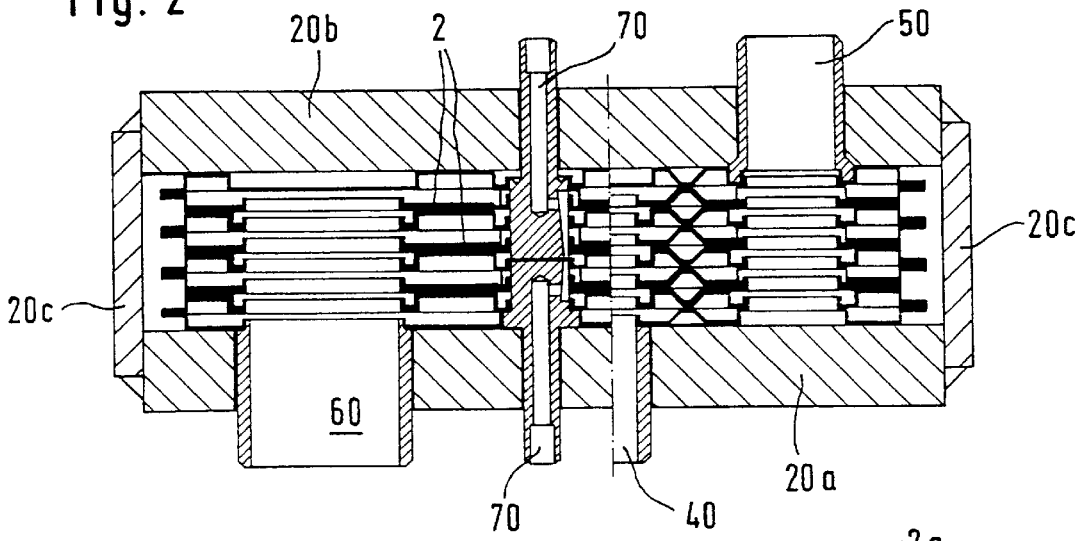
FIG. 2 is a schematic drawing of a side sectional view of a preferred embodiment of an inventive plate heat exchanger along the line A—A of FIG. 1.

FIG. 2 is a side sectional view of a preferred embodiment of a plate heat exchanger of the invention. It is evident that a number of heat transfer plates 2 are stacked one above the other. The heat transfer plates 2 are hereby arranged in a housing 20, which exhibits a bottom part 20*a*, an upper part 20*b* and side walls 20*c*. One recognizes that the stacked arrangement of the boreholes 4 produces an inlet channel 40, over which a heat exchanger medium can be passed into secondary sided flow channels. The secondary sided flow channels in turn communicate with an outlet channel 50, which is formed by the stacking arrangement of the boreholes 5. A medium to be evaporated can be passed correspondingly over an inlet channel 70 (formed by stacking the boreholes 7 one above the other) into primary sided flow channels, which in turn communicate with an outlet channel 50, which is produced by stacking the boreholes 5 one above the other. The primary and secondary sided flow channels do not communicate with each other. It must be noted that in the drawing of FIG. 2 two of the inlet channels 70, introduced from opposite sides, are formed. It is also possible in the same manner to provide only one inlet channel 70, which communicates with all of the primary sided flow channels. All channels exhibit cylindrical tubes, which are formed with corresponding openings in their side walls for the purpose of creating the respective desired connections with the flow channels.

Figure 3:
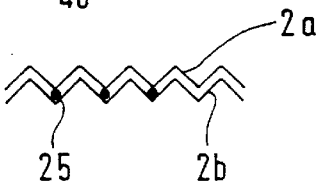
FIG. 3 is a schematic drawing depicting the meshing of the patterning of two stacked heat transfer plates.

At this point the invention provides that the primary and secondary sided flow channels are formed with different channel diameters or volumes. To form a primary sided channel structure, through which in particular a heat exchanger medium is supposed to flow, two heat transfer plates, as depicted in FIG. 1, are stacked and fixed in position relative to one another in such a manner for this purpose that the respective fishbone-like patterning runs parallel to each other. At the same time the elevations of the one heat transfer plate project at least partially into the depressions of the second heat transfer plate, as depicted by the schematic drawing in FIG. 3.

The stacked patterning is marked here with the numerals 2*a*, 2*b*. One recognizes in FIG. 3 that between the heat transfer plates or the patterning 2*a*, 2*b* there are spacing elements 25, with which a desired or necessary spacing between the patterning 2*a*, 2*b* can be adjusted. The spacing elements 25 are also depicted schematically in the upper right region of the heat transfer plate 2, shown in FIG. 1. With this meshing patterning the heat transfer plates 2*a*, 2*b* can be arranged significantly closer together, as compared with a stacked fishbone-like patterning, which runs in the opposite direction or does not run parallel to each other.

In this respect it has been demonstrated to be advantageous for the secondary sided flow channels, through which the heat exchanger medium flows, to be designed in such a manner that the fishbone-like patterning of the heat transfer plates is arranged alternatingly or cross-shaped one above the other for the purpose of forming cross channel structures. This can be achieved, for example, with the use of heat exchanger plates that exhibit a W- or M-shaped patterning.

The primary sided or evaporator sided volume reduction, realized by the invention, provides an improved dynamic over the conventional plate heat exchangers.

The height of the primary sided or secondary sided channels can be adjusted with the spacing elements 25.

The heat transfer plates, used according to the invention, are produced in a simple manner by embossing, for example, a sheet metal plate. It is possible to join the individual heat transfer plates, in particular also to guarantee the desired communication between the boreholes 4, 5, 6, 7 and the primary and secondary sided flow channels, for example, by soldering or welding.

It is also clear from FIG. 1 that the sweep of the fishbone-like patterning decreases in the direction of the flow direction of the medium to be evaporated, that is, in the drawing of FIG. 1 from the bottom to the top along the central axis M. This means that in the region of the inlet opening 7 a relatively large or obtuse angle, which becomes smaller or more acute in the direction of the outlet borehole 5, is formed between the center axis M and the individual segments of the fishbone-like patterning. Such a variation in the sweep angle can minimize the pressure losses that occur in different phases of the medium to be evaporated.

Furthermore, it is evident that the boreholes or channels 7, 5 and 4, 6, assigned to the respective heat exchanger mediums, are arranged in the shape of a Y relative to the center axis M of the heat transfer plate 2. As stated, the medium to be evaporated flows, for example, through the borehole 7 into the plate heat exchanger and leaves the same through the boreholes 5. Thus, the medium to be evaporated flows essentially in the shape of a Y through the plate heat exchanger, a feature that results in symmetrical temperature distribution inside the plate heat exchanger or the heat transfer plates. Thus, the thermal or mechanical stress of the heat transfer plates can be effectively reduced over the conventional solutions.

A fuel gas sided adjustment of the pressure losses, i.e. pressure loss of the heat exchanger medium, can be optimized by suitably designing the fishbone-like patterning of the secondary channels. For this purpose, for example, the elevations or depressions of the respective flow channels can be rounded off, and not be peaked and angular, as shown schematically in FIG. 3.

Furthermore, the spacing elements 25 result in turbulence of the heat exchanger medium, flowing through the primary sided flow channels, thus further improving the heat exchange effect of the plate heat exchanger.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Plate heat exchanger, comprising:

heat transfer plates which exhibit a patterning stacked one above the other, and between which primary sided flow channels are formed for a first heat exchanger medium to be evaporated, and secondary sided channels are formed for a second heat exchanger heat carrier medium, wherein at least some of the primary sided and secondary sided flow channels are formed between two adjacent heat transfer plates, with patterning meshing at least partially, while maintaining a minimum spacing; wherein the primary sided flow channels have two patternings extending essentially in the same direction and the secondary sided flow channels have flow channels with patterning extending in the opposite direction such that cross channel structures are produced; and the heat transfer plates have a fishbone-like patterning wherein the angle of sweep of the fishbone-like patterning decreases relative to the center axis in the direction of flow of the medium.

2. Plate heat exchanger as claimed in claim 1, wherein the heat transfer plates are made of sheet metal with a fishbone-like patterning and are stacked one above the other to form the primary sided flow channels with two patternings extending essentially in the same direction, and to form the secondary sided flow channels with patterning extending in the opposite direction to produce cross channel structures.

3. Plate heat exchanger as claimed in claim 2, wherein spacing elements are provided between the corresponding heat transfer plates for the purpose of adjusting the height of the primary sided and/or secondary sided flow channels.

4. Plate heat exchanger as claimed in claim 3, wherein a sweep angle of the patterning of the heat transfer plates is designed variable in a main direction of flow relative to the center axis M of the plate heat exchanger.

5. Plate heat exchanger according to claim 2, comprising an inlet channel for at least one heat exchanger medium which extends through the heat transfer plates and communicates with the primary sided or secondary sided flow channels, for the purpose of introducing the heat exchanger medium into the plate heat exchanger, and two outlet channels, which extend through the heat transfer plates and communicate with the primary sided or secondary sided flow channels, for the purpose of dispensing the heat exchanger medium.

6. Plate heat exchanger as claimed in claim 5, wherein the inlet channel on one end of the plate heat exchanger is disposed in a region of its center axis relative to the main direction of flow, and the outlet channels on the respective other end of the plate heat exchanger are offset symmetrically relative to the center axis.

7. Plate heat exchanger as claimed in claim 5, wherein the primary sided and/or secondary sided flow channels exhibit a coating.

8. Plate heat exchanger as claimed in claim 7, wherein the coating is doped with a catalyst material.

9. Plate heat exchanger as claimed in claim 2, wherein a sweep angle of the patterning of the heat transfer plates is designed variable in a main direction of flow relative to the center axis M of the plate heat exchanger.

10. Plate heat exchanger as claimed in claim 1, wherein spacing elements are provided between the corresponding heat transfer plates for the purpose of adjusting the height of the primary sided and/or secondary sided flow channels.

11. Plate heat exchanger according to claim 10, comprising an inlet channel for at least one heat exchanger medium which extends through the heat transfer plates and communicates with the primary sided or secondary sided flow channels, for the purpose of introducing the heat exchanger medium into the plate heat exchanger, and two outlet channels, which extend through the heat transfer plates and communicate with the primary sided or secondary sided flow channels, for the purpose of dispensing the heat exchanger medium.

12. Plate heat exchanger as claimed in claim 11, wherein the inlet channel on one end of the plate heat exchanger is disposed in a region of its center axis relative to the main direction of flow, and the outlet channels on the respective other end of the plate heat exchanger are offset symmetrically relative to the center axis.

13. Plate heat exchanger as claimed in claim 12, wherein a sweep angle of the patterning of the heat transfer plates is designed variable in a main direction of flow relative to the center axis M of the plate heat exchanger.

14. Plate heat exchanger according to claim 1, comprising an inlet channel for at least one heat exchanger medium which extends through the heat transfer plates and communicates with the primary sided or secondary sided flow channels, for the purpose of introducing the heat exchanger medium into the plate heat exchanger, and two outlet channels, which extend through the heat transfer plates and communicate with the primary sided or secondary sided flow channels, for the purpose of dispensing the heat exchanger medium.

15. Plate heat exchanger as claimed in claim 14, wherein the inlet channel on one end of the plate heat exchanger is disposed in a region of its center axis relative to the main direction of flow, and the outlet channels on the respective other end of the plate heat exchanger are offset symmetrically relative to the center axis.

16. Plate heat exchanger as claimed in claim 15, wherein a sweep angle of the patterning of the heat transfer plates is designed variable in a main direction of flow relative to the center axis M of the plate heat exchanger.

17. Plate heat exchanger as claimed in claim 14, wherein a sweep angle of the patterning of the heat transfer plates is designed variable in a main direction of flow relative to the center axis of the plate heat exchanger.

18. Plate heat exchanger as claimed in claim 1, wherein the primary sided and/or secondary sided flow channels exhibit a coating.

19. Plate heat exchanger as claimed in claim 18, wherein the coating is doped with a catalyst material.

20. A method of making a plate heat exchanger, which includes heat transfer plates stacked one above the other to form respective primary sided flow channels for a first heat exchanger medium and secondary sided flow channel for a second heat exchanger medium, said method comprising:

embossing patterning into a plurality of sheet metal plates with elevations and depressions, stacking said plates one above the other while maintaining minimum spacing with respective patterning elevations and depressions of one plate meshing with corresponding respective depressions and elevations of an adjacent plate, and connecting said plates together; wherein the primary sided flow channels have two patternings extending essentially in the same direction and the secondary sided flow channels have flow channels with patterning extending in the opposite direction such that cross channel structures are produced; and the heat transfer plates have a fishbone-like patterning wherein the angle of sweep of the fishbone-like patterning decreases relative to the center axis in the direction of flow of the medium.

21. A method according to claim 20, wherein the heat transfer plates are made of sheet metal with a fishbone-like patterning and are stacked one above the other to form the primary sided flow channels with two patternings extending essentially in the same direction, and to form the secondary sided flow channels with patterning extending in the opposite direction to produce cross channel structures.

* * * * *